US009691600B2

(12) United States Patent
Zukawa et al.

(10) Patent No.: US 9,691,600 B2
(45) Date of Patent: Jun. 27, 2017

(54) ULTRAVIOLET LIGHT EMITTING DEVICE

(71) Applicant: Panasonic Intellectual Property Management Co., Ltd., Osaka (JP)

(72) Inventors: Takehiro Zukawa, Osaka (JP); Yoshiki Sasaki, Osaka (JP); Nobuaki Nagao, Gifu (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/073,624

(22) Filed: Mar. 17, 2016

(65) Prior Publication Data

US 2016/0300705 A1 Oct. 13, 2016

(30) Foreign Application Priority Data

Apr. 8, 2015 (JP) ..... 2015-079528

(51) Int. Cl.

| | |
|---|---|
| ***H01J 61/44*** | (2006.01) |
| ***H01J 61/16*** | (2006.01) |
| ***H01J 65/00*** | (2006.01) |
| *H01J 61/30* | (2006.01) |

(52) U.S. Cl.

CPC ..... *H01J 61/44* (2013.01); *H01J 61/16* (2013.01); *H01J 61/305* (2013.01); *H01J 65/00* (2013.01); *H01J 61/302* (2013.01)

(58) Field of Classification Search

CPC ..... H01J 61/44; H01J 61/305; H01J 61/16; H01J 65/00; H01J 61/302

See application file for complete search history.

(56) References Cited

U.S. PATENT DOCUMENTS

| | | | |
|---|---|---|---|
| 2005/0010249 | A1 | 1/2005 | Minamoto et al. |
| 2009/0179547 | A1 | 7/2009 | Auday et al. |

FOREIGN PATENT DOCUMENTS

| | | |
|---|---|---|
| JP | 2001-081460 | 3/2001 |
| JP | 2001-172624 | 6/2001 |
| JP | 2004-350946 | 12/2004 |
| JP | 2009-505365 | 2/2009 |

*Primary Examiner* — Tracie Y Green

(74) *Attorney, Agent, or Firm* — McDermott Will & Emery LLP

(57) ABSTRACT

An ultraviolet light emitting device includes: a first substrate; a second substrate; a gas in a space between the first substrate and the second substrate; electrodes directly or indirectly on a first main surface of the first substrate; a dielectric layer that is located in a first region directly or indirectly on the first main surface of the first substrate and covers the electrodes, the dielectric layer being not located in a second region directly or indirectly on the first main surface of the first substrate, the second region being different from the first region, the first region including regions in which the electrodes are located; and a light-emitting layer that is located in the second region and/or located directly or indirectly on at least one of second and third main surfaces of the second substrate and emits the ultraviolet light in the gas due to electrical discharge between the electrodes.

11 Claims, 7 Drawing Sheets

FIG. 7

| | MATERIAL OF LIGHT-EMITTING LAYER | DIELECTRIC LAYER | INITIAL DISCHARGE VOLTAGE | INITIAL EMISSION INTENSITY |
|---|---|---|---|---|
| COMPARATIVE EXAMPLE 1 | $YBO_3$: Gd | ENTIRE SURFACE | 675 V | 100 |
| COMPARATIVE EXAMPLE 2 | MgO POWDER | ENTIRE SURFACE | 600 V | 180 |
| EXAMPLE 1 | $YBO_3$: Gd | ONLY ON ELECTRODE | 675 V | 130 |
| EXAMPLE 2 | MgO POWDER | ONLY ON ELECTRODE | 600 V | 200 |

ULTRAVIOLET LIGHT EMITTING DEVICE

BACKGROUND

1. Technical Field

The present disclosure relates to an ultraviolet light emitting device.

2. Description of the Related Art

Deep ultraviolet light having a wavelength of approximately 200 to 350 nm is utilized in various fields of sterilization, water purification, lithography, and illumination. Hitherto, mercury lamps have been widely used as deep ultraviolet light sources. Mercury lamps utilize a mercury glow discharge. From the perspective of the reduction of load on the environment, however, regulations for environmentally hazardous substances, such as mercury, are being tightened up, as in WEEE & RoHS directives in Europe. Thus, there is a demand for alternative light sources to mercury lamps. Mercury lamps are point emission sources. For lithography, which requires wide and uniform intensity light, therefore, mercury lamps require complex light source design.

An example of deep ultraviolet light sources free of mercury may be a deep ultraviolet light emitting diode (DUV-LED). Another example of deep ultraviolet light sources free of mercury may be an excimer lamp, which emits deep ultraviolet light by excitation of a discharge gas, such as krypton chloride (KrCl), by barrier discharge.

Still another deep ultraviolet light source free of mercury may be a deep ultraviolet light emitting device that includes a phosphor in combination with barrier discharge (see, for example, Japanese Unexamined Patent Application Publication (Translation of PCT Application) No. 2009-505365). This deep ultraviolet light emitting device emits deep ultraviolet light by irradiating the phosphor with vacuum ultraviolet light generated by excitation of a noble gas, such as xenon (Xe), by barrier discharge.

More specifically, Japanese Unexamined Patent Application Publication (Translation of PCT Application) No. 2009-505365 discloses a light-emitting device that produces surface-emitted ultraviolet light by applying an alternating voltage to electrodes on a substrate in a discharge space to cause electrical discharge. The discharge space contains a phosphor that emits ultraviolet light. Such a deep ultraviolet light emitting device that includes a phosphor in combination with barrier discharge advantageously has a high degree of freedom of shape due to flexible arrangement of local electrical discharge and possibly requires no complex light source design.

SUMMARY

The known deep ultraviolet light emitting device can emit ultraviolet light from only one surface. One non-limiting and exemplary embodiment provides an ultraviolet light emitting device that can emit ultraviolet light from opposite sides thereof.

In one general aspect, the techniques disclosed here feature an ultraviolet light emitting device that includes a first substrate that has a first main surface and is transparent to ultraviolet light; a second substrate that has a second main surface and a third main surface and is transparent to ultraviolet light, the second main surface facing the first main surface of the first substrate, the third main surface being opposite the second main surface; a gas in a space between the first substrate and the second substrate; electrodes directly or indirectly on the first main surface of the first substrate; a dielectric layer that is located in a first region directly or indirectly on the first main surface of the first substrate and covers the electrodes, the dielectric layer being not located in a second region directly or indirectly on the first main surface of the first substrate, the second region being different from the first region, the first region including regions in which the electrodes are located; and a light-emitting layer that is located in the second region and/or located directly or indirectly on at least one of the second and third main surfaces of the second substrate and emits the ultraviolet light in the gas due to electrical discharge between the electrodes.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

BRIEF DESCRIPTION OF THE DRAWINGS

FIG. 7 is a table of the characteristic evaluation results for ultraviolet light emitting devices according to embodiments and comparative examples.

DETAILED DESCRIPTION

Outline of Present Disclosure

Figure 1:
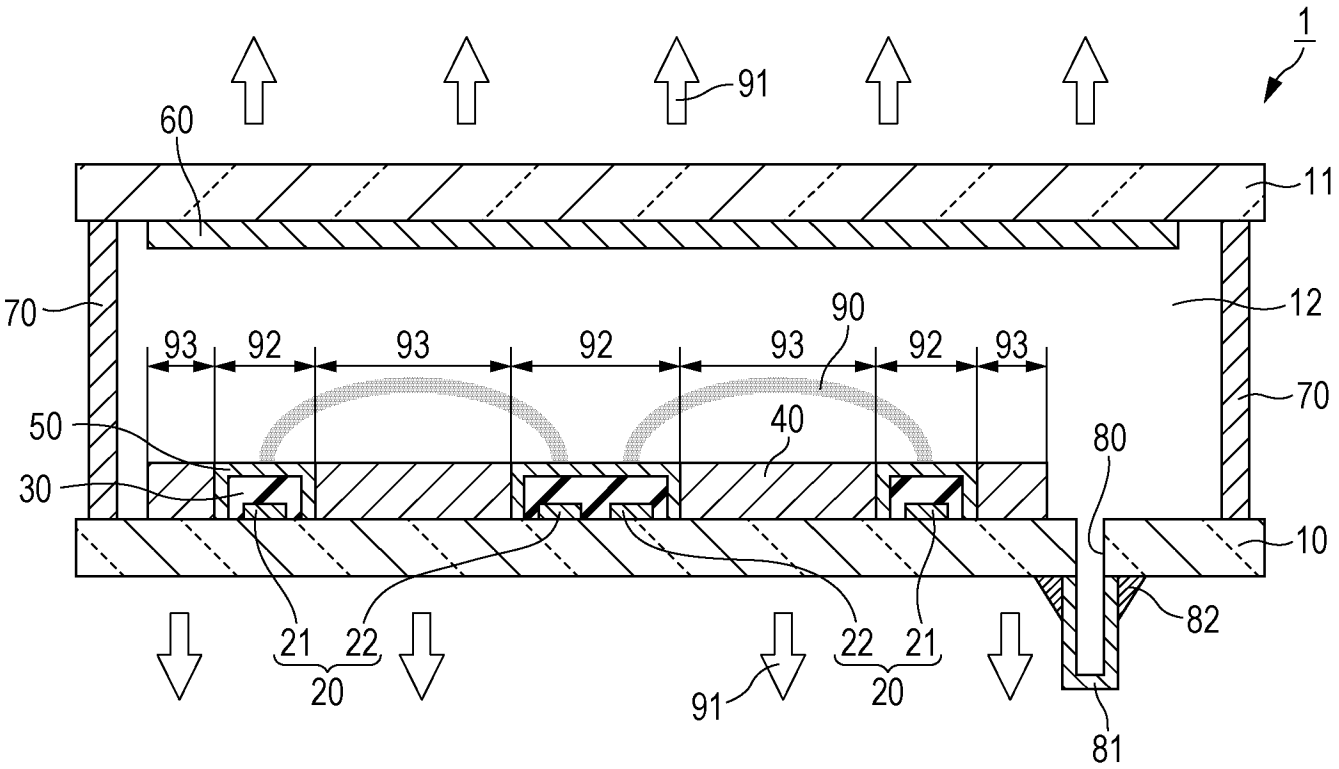
FIG. 1 is a cross-sectional view of an ultraviolet light emitting device according to one embodiment.

The outline of an ultraviolet light emitting device according to the present disclosure will be described below.

When deep ultraviolet light emitting devices are used for sterilization of water or air, water or air is efficiently sterilized by placing a deep ultraviolet light emitting device in the center. Thus, ultraviolet light is preferably emitted from opposite sides of a substrate.

In known deep ultraviolet light emitting devices, however, because deep ultraviolet light has a very short wavelength, deep ultraviolet light is absorbed by a dielectric layer covering electrodes. Thus, it is difficult to emit deep ultraviolet light from opposite sides of a substrate in known deep ultraviolet light emitting devices. In particular, deep ultraviolet light having a peak of 250 nm or less emitted from MgO powders is close to vacuum ultraviolet light, and most of the deep ultraviolet light is absorbed by a dielectric layer. Thus, the problem is more significant in this case.

Absorption by a dielectric layer may be reduced by using a material that is sufficiently transparent to ultraviolet light, such as $SiO_2$. However, $SiO_2$ has a very high melting point and is not formed into a film by coating and baking. Instead, a $SiO_2$ film is formed by a vacuum process, such as a sputtering process. Thus, the use of a material that is sufficiently transparent to ultraviolet light, such as $SiO_2$, for a dielectric layer entails a high process cost.

Accordingly, the present disclosure provides a simple ultraviolet light emitting device that can emit ultraviolet light from opposite sides thereof and that does not entail a high production cost and high material costs.

An ultraviolet light emitting device according to one aspect of the present disclosure includes a first substrate that has a first main surface and is transparent to ultraviolet light; a second substrate that has a second main surface and a third main surface and is transparent to ultraviolet light, the second main surface facing the first main surface of the first substrate, the third main surface being opposite the second main surface; a gas in a space between the first substrate and the second substrate; electrodes directly or indirectly on the first main surface of the first substrate; a dielectric layer that is located in a first region directly or indirectly on the first main surface of the first substrate and covers the electrodes, the dielectric layer being not located in a second region directly or indirectly on the first main surface of the first substrate, the second region being different from the first region, the first region including regions in which the electrodes are located; and a light-emitting layer that is located in the second region and/or located directly or indirectly on at least one of the second and third main surfaces of the second substrate and emits the ultraviolet light in the gas due to electrical discharge between the electrodes.

No dielectric layer that absorbs ultraviolet light is located between the light-emitting layer and the first substrate and between the light-emitting layer and the second substrate. This can prevent ultraviolet light emitted from the light-emitting layer from being absorbed by a dielectric layer. Thus, an ultraviolet light emitting device according to the present embodiment can efficiently emit ultraviolet light from opposite sides thereof.

The light-emitting layer may not be located on a surface of the dielectric layer, the surface facing the second substrate.

Because no light-emitting layer is located on the dielectric layer, the discharging characteristics depend on the secondary electron emission characteristics of the dielectric layer. Variations in the secondary electron emission characteristics are smaller in the dielectric layer than in the light-emitting layer. Thus, the decrease in discharge intensity during continuous emission can be suppressed.

The ultraviolet light emitting device may further include a thin film that is located directly or indirectly on the dielectric layer and that contains at least one of magnesium oxide, calcium oxide, barium oxide, and strontium oxide.

The thin film serving as a protective layer can decrease the change in secondary electron emission characteristics and thereby suppress the decrease in discharge intensity during continuous emission.

The light-emitting layer may contain powdered magnesium oxide that emits the ultraviolet light.

Magnesium oxide has good secondary electron emission characteristics and can lower the initial discharge voltage. Magnesium oxide is resistant to ion bombardment and can suppress the degradation of the light-emitting layer due to ion bombardment caused by electrical discharge.

The light-emitting layer may further contain a halogen atom.

The powdered magnesium oxide containing a halogen atom can strengthen ultraviolet emission.

The halogen atom may be fluorine.

The powdered magnesium oxide containing fluorine can strengthen ultraviolet emission.

The first substrate and the second substrate may be formed of sapphire.

Because sapphire has a high ultraviolet transmittance, ultraviolet light can be efficiently emitted from the first substrate and the second substrate in opposite directions.

The gas may contain neon and xenon.

A gas mixture of neon and xenon emits excitation light having a wavelength of approximately 147 nm during electrical discharge. Since a MgO powder efficiently emits light in response to excitation light having a wavelength of approximately 150 nm, the gas mixture can increase the emission intensity.

The ultraviolet light may have a peak wavelength in the range of 200 to 300 nm.

This allows the ultraviolet light emitting device to be effectively used particularly for sterilization, water purification, and lithography.

The light-emitting layer may have a fourth surface that is located in the second region and that faces the first substrate. The dielectric layer may have a fifth surface that faces the first substrate. The fourth and fifth surfaces may be substantially located directly on a hypothetical flat plane. The first and second substrates may be composed mainly of a material that is transparent to the ultraviolet light. The phrase "composed mainly of", as used herein, means that the component constitutes 50% by weight or more.

The embodiments of the present disclosure will be more specifically described with reference to the accompanying drawings.

The following embodiments are general or specific examples. The numerical values, shapes, materials, components, arrangement and connection of the components, steps, and sequential order of steps in the following embodiments are only examples and are not intended to limit the present disclosure. Among the components in the following embodiments, components not described in the highest level concepts of the independent claims are described as optional components.

The accompanying figures are schematic figures and are not necessarily precise figures. The same reference numerals denote the same or equivalent parts throughout the figures.

The term "above" or "over" and "below" or "under", as used herein, does not necessarily indicate upward (vertically upward) and downward (vertically downward) in the sense of absolute spatial perception but indicates the relative positional relationship based on the stacking sequence in multilayer structures. More specifically, "above" or "over" indicates the direction perpendicular to the main surface of the first substrate and the direction from the first substrate to the second substrate, and "below" or "under" indicates the opposite direction. The term "over", "under", or "on", as used herein, indicates not only a case where two components are disposed with a space therebetween but also a case where two components are in contact with each other.

Embodiments

1. Structure

1-1. Outline

An ultraviolet light emitting device according to one embodiment of the present disclosure will be described below with reference to FIG. 1. FIG. 1 is a schematic cross-sectional view of an ultraviolet light emitting device 1 according to the present embodiment.

In the ultraviolet light emitting device 1, a phosphor is used in combination with barrier discharge. As illustrated in FIG. 1, the ultraviolet light emitting device 1 includes a first substrate 10, a second substrate 11, electrodes 20, a dielectric layer 30, a light-emitting layer 40, a protective layer 50, a light-emitting layer 60, a sealing member 70, and a tip tube 81.

In the ultraviolet light emitting device 1, the first substrate 10 and the second substrate 11 are joined together with the sealing member 70, thus forming a discharge space 12. The electrodes 20 to which a voltage is applied to cause electrical discharge 90 are located on the first substrate 10 and are covered with the dielectric layer 30. The protective layer 50 for protecting the dielectric layer 30 from ion bombardment is located on the dielectric layer 30. The light-emitting layer 40 that emits ultraviolet light is located between the electrodes 20. The light-emitting layer 60 is located on the electrical discharge side of the second substrate 11.

Ultraviolet light from the light-emitting layers 40 and 60 is emitted not only from the second substrate 11 but also from the first substrate 10 (ultraviolet light 91 in FIG. 1). More specifically, the ultraviolet light 91 is deep ultraviolet light having a peak wavelength in the range of 200 to 350 nm. For example, the ultraviolet light 91 has a peak wavelength in the range of 200 to 300 nm.

The components of the ultraviolet light emitting device 1 will be described in detail below.

1-2. Substrate

A main surface of the first substrate 10 faces a main surface of the second substrate 11. The first substrate 10 is separated by a predetermined distance from the second substrate 11. For example, the predetermined distance is 1 mm. In the present embodiment, the first substrate 10 and the second substrate 11 are flat sheets. The first substrate 10 may have almost the same shape and size as the second substrate 11.

The first substrate 10 is hermetically bonded to the second substrate 11 with the sealing member 70. Thus, the discharge space 12 is formed between the first substrate 10 and the second substrate 11. The discharge space 12 is filled with a predetermined gas. More specifically, the discharge space 12 contains a discharge gas, such as xenon (Xe), krypton chloride (KrCl), fluorine ($F_2$), neon (Ne), helium (He), carbon monoxide (CO), nitrogen ($N_2$), or any combination thereof, at a predetermined pressure. In the present embodiment, the discharge space 12 may be filled with a gas containing neon and xenon.

The first substrate 10 and the second substrate 11 are composed mainly of a material that is transparent to ultraviolet light. More specifically, the first substrate 10 and the second substrate 11 are formed of a material that is transparent to deep ultraviolet light. Thus, deep ultraviolet light from the light-emitting layers 40 and 60 can be emitted outside the device from the first substrate 10 and the second substrate 11. Examples of the material that is transparent to deep ultraviolet light include special glass that is transparent to deep ultraviolet light, quartz glass ($SiO_2$), magnesium fluoride ($MgF_2$), calcium fluoride ($CaF_2$), lithium fluoride (LiF), or sapphire glass ($Al_2O_3$).

In the present embodiment, the first substrate 10 and the second substrate 11 are formed of sapphire, which is transparent to deep ultraviolet light emitted from the light-emitting layers 40 and 60, in order to emit the deep ultraviolet light outside the device. Thus, as illustrated in FIG. 1, the ultraviolet light 91 is emitted from the first substrate 10 and the second substrate 11 in opposite directions. The occurrence of cracks and fissures in the protective layer 50 and the sealing member 70 can be reduced when the first substrate 10 and the second substrate 11 are formed of a glass having a typical thermal expansion coefficient or sapphire, which has a thermal expansion coefficient close to the thermal expansion coefficient of a MgO thin film of the protective layer 50.

1-3. Electrodes

The electrodes 20 are located between the dielectric layer 30 and the first substrate 10. More specifically, the electrodes 20 are located on the main surface of the first substrate 10. The main surface of the first substrate 10 is a surface (top surface) of the first substrate 10 facing the second substrate 11 or the discharge space 12.

The electrodes 20 are covered with the dielectric layer 30. Although the electrodes 20 are in contact with the main surface of the first substrate 10 in the present embodiment, the electrodes 20 may be separated from the first substrate 10. For example, a buffer layer, such as an insulating film, may be located between the electrodes 20 and the main surface of the first substrate 10.

As illustrated in FIG. 1, each of the electrodes 20 includes a pair of electrodes: a first electrode 21 and a second electrode 22. Different voltages are applied to the first electrode 21 and the second electrode 22.

Figure 2:
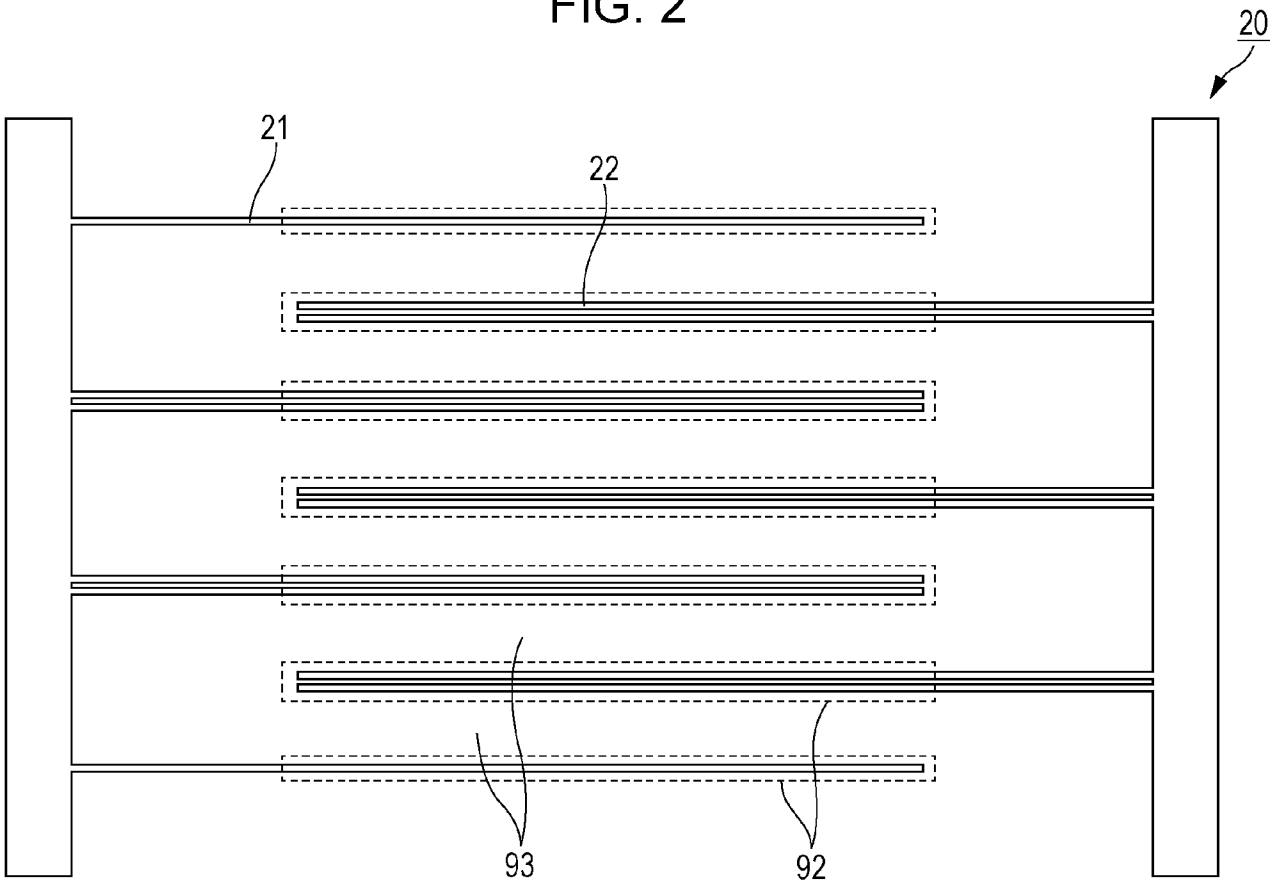
FIG. 2 is a plan view of an electrode of an ultraviolet light emitting device according to one embodiment.

FIG. 2 is a schematic plan view of the electrodes 20 of the ultraviolet light emitting device 1 according to the present embodiment. As illustrated in FIG. 2, for example, the electrodes 20 include pairs of strip electrodes (or linear electrodes having a predetermined width) arranged in parallel. More specifically, two parallel first strip electrodes 21 and two parallel second strip electrodes 22 are alternately arranged. The first electrodes 21 are electrically connected at one end so as to have the same voltage. More specifically, the first electrodes 21 have a comb-like structure. The second electrodes 22 also have a comb-like structure.

The material of the electrodes 20 may be a thick Ag film or a thin metal film, such as an Al thin film or a Cr/Cu/Cr multilayer thin film. For example, each of the electrodes 20 has a thickness of several micrometers. For example, the distance between the first electrode 21 and adjacent second electrode 22 ranges from approximately 0.1 mm to several millimeters.

An alternating wave, such as a rectangular wave or a sine wave, is applied to the electrodes 20 by a drive circuit (not shown). In general, when the phase of the voltage applied to a first electrode 21 is opposite to the phase of the voltage applied to the second electrode 22 in the same pair, light emission is enhanced. Electrical discharge can also be induced when a rectangular voltage is applied to the first electrodes 21 while the second electrodes 22 are grounded. The electrode 20 does not necessarily include a pair of electrodes. The electrode 20 may include a group of three or more strip electrodes in order to change the discharge area or to lower the initial discharge voltage.

1-4. Dielectric Layer

The dielectric layer 30 is located between the first substrate 10 and the second substrate 11. In the present embodiment, the dielectric layer 30 is located in first regions 92 in such a manner as to cover the electrodes 20 and is not located in second regions 93. More specifically, the dielectric layer 30 is in contact with the main surface of the first substrate 10 in such a manner as to cover the electrodes 20. In other words, the dielectric layer 30 is not located over the entire main surface of the first substrate 10 but is located in the form of islands.

The first regions 92 on the main surface of the first substrate 10 include regions in which the electrodes 20 are located. More specifically, the first regions 92 include the electrodes 20 and the vicinity of each of the electrodes 20. For example, as illustrated in FIG. 2, the planar shapes of the first regions 92 are parallel strips arranged at predetermined intervals.

The second regions 93 on the main surface of the first substrate 10 are different from the first regions 92. More specifically, each of the second regions 93 is located between the first electrode 21 and the second electrode 22. For example, as illustrated in FIG. 2, the planar shapes of the second regions 93 are parallel strips arranged at predetermined intervals.

Although two second electrodes 22 are covered with one strip of the dielectric layer 30 in FIG. 1, another structure is also possible. For example, one strip of the dielectric layer 30 may cover one first electrode 21, and another strip of the dielectric layer 30 may cover one second electrode 22. The dielectric layer 30 may cover only the upper surface of the electrodes 20. More specifically, the planar shapes of the first regions 92 may be identical to the planar shapes of the electrodes 20. The area of the light-emitting layer 40 viewed from the top can be increased by making the first regions 92 smaller and the second regions 93 larger. This can increase the emission intensity of the ultraviolet light emitting device 1.

The dielectric layer 30 may be formed from a low-melting-point glass composed mainly of lead oxide (PbO), bismuth oxide ($Bi_2O_3$), or phosphorus oxide ($PO_4$) by a screen printing method and may have a thickness of approximately 30 μm. When the electrodes 20 are covered with such an insulating material of the dielectric layer 30, the electrical discharge becomes barrier discharge. In barrier discharge, the electrodes 20 are not directly exposed to ions, thus resulting in a small time-dependent change in emission intensity during continuous emission. Thus, barrier discharge is suitable for applications that require long-term continuous emission, such as sterilization devices and lithography. The thickness of the dielectric layer 30 has an influence on the electric field strength applied to the discharge space 12 and depends on the size of the device (for example, the size of the first substrate 10 and the second substrate 11) and the desired characteristics.

1-5. Light-Emitting Layer

The light-emitting layer 40 is located in the second regions 93 and emits ultraviolet light. In the present embodiment, the light-emitting layer 40 is in contact with the main surface of the first substrate 10. As illustrated in FIG. 1, a surface (bottom surface) of the light-emitting layer 40 proximate to the first substrate 10 is substantially flush with a surface (bottom surface) of the dielectric layer 30 proximate to the first substrate 10. In other words, the light-emitting layer 40 and the dielectric layer 30 are located on the same layer.

In the present embodiment, the light-emitting layer 40 is not located on the dielectric layer 30. More specifically, the light-emitting layer 40 is not located in the first regions 92. As illustrated in FIG. 1, the protective layer 50 (the dielectric layer 30 in the absence of the protective layer 50) is exposed to the discharge space 12. A surface (upper surface) of the light-emitting layer 40 proximate to the second substrate 11 may be substantially flush with a surface (upper surface) of the protective layer 50 proximate to the second substrate 11. The light-emitting layer 40 may have a thickness in the range of 20 to 30 μm.

The light-emitting layer 60 is located on the main surface of the second substrate 11 and emits ultraviolet light. The main surface of the second substrate 11 is a surface (bottom surface) of the second substrate 11 facing the first substrate 10 or the discharge space 12. The light-emitting layer on the second substrate 11 can enhance emission intensity. The light-emitting layer 60 may have a thickness of 30 μm or less.

The light-emitting layer 60 may be located opposite the main surface of the second substrate 11. In other words, the light-emitting layer 60 may be outside the discharge space 12 of the ultraviolet light emitting device 1. When powdered MgO is used in the light-emitting layer 60, it is desirable that the powdered MgO be located in the discharge space 12 on the electrical discharge side of the second substrate 11 because the powdered MgO is susceptible to carbonation in the air.

From the perspective of luminous efficiency and simplicity of the production process, the material of the light-emitting layer 40 and the light-emitting layer 60 may be a phosphor that emits ultraviolet light. The phosphor may be $YPO_4$:Pr, $YPO_4$:Nd, $LaPO_4$:Pr, $LaPO_4$:Nd, $YF_3$:Ce, $SrB_6O_{10}$:Ce, YOBr:Pr, $LiSrAlF_6$:Ce, $LiCaAlF_6$:Ce, $LaF_3$:Ce, $Li_6Y(BO_3)_3$:Pr, $BaY_2F_8$:Nd, YOCl:Pr, $YF_3$:Nd, $LiYF_4$:Nd, $BaY_2F_8$:Pr, $K_2YF_5$:Pr, or $LaF_3$:Nd each doped with a rare-earth luminescent center. The phosphor may also be MgO, ZnO, AlN, diamond, or BN, which emits light due to a crystal defect or a band gap.

In the present embodiment, the light-emitting layer 40 and the light-emitting layer 60 contain powdered magnesium oxide (MgO) that emits ultraviolet light. The light-emitting layer 40 and the light-emitting layer 60 may further contain a halogen atom. The halogen atom may be fluorine (F).

The light-emitting layer 40 and the light-emitting layer 60 emit light due to electrical discharge between the electrodes 20 in the discharge space 12 filled with the gas. More specifically, the phosphor in the light-emitting layer 40 and the light-emitting layer 60 emits ultraviolet light by irradiation with excitation light resulting from electrical discharge. For example, the light-emitting layer 40 and the light-emitting layer 60 emit ultraviolet light having a peak wavelength in the range of 200 to 300 nm (deep ultraviolet light). For example, the excitation light is vacuum ultraviolet light or deep ultraviolet light.

1-6. Protective Layer

The protective layer 50 is a thin film located on the dielectric layer 30. The protective layer 50 functions to decrease the voltage that causes electrical discharge (initial discharge voltage) and protect the dielectric layer 30 and the electrodes 20 from ion bombardment caused by electrical discharge.

The protective layer 50 is a thin film that contains at least one of magnesium oxide (MgO), calcium oxide (CaO), barium oxide (BaO), and strontium oxide (SrO). The protective layer 50 may be a mixed-phase thin film containing two or more of MgO, CaO, BaO, and SrO. In particular, a MgO thin film has high ion bombardment resistance and can provide an ultraviolet light emitting device that has a very small time-dependent decrease in discharge intensity. The protective layer 50 may have a thickness of 1 μm.

Although the protective layer 50 and the light-emitting layer 40 are composed mainly of MgO, they have different film qualities. For example, the light-emitting layer 40 contains powdered MgO, has many defect levels, and has a poor film quality. Thus, the light-emitting layer 40 can easily release electrons and emit ultraviolet light. In contrast, the protective layer 50 may be formed of a MgO thin film and has a better film quality than the light-emitting layer 40.

1-7. Sealing Member

The sealing member 70 holds the first substrate 10 and the second substrate 11 at a predetermined distance. The sealing member 70 is located circularly along the periphery of the first substrate 10 and the periphery of the second substrate 11. The discharge space 12 is a space surrounded by the annular sealing member 70, the first substrate 10, and the second substrate 11.

The sealing member 70 may be formed of a frit composed mainly of $Bi_2O_3$ or $V_2O_5$. The frit composed mainly of $Bi_2O_3$ may be a mixture of a $Bi_2O_3$—$B_2O_3$—RO-MO glass material (where R denotes one of Ba, Sr, Ca, and Mg, and M denotes one of Cu, Sb, and Fe) and an oxide filler, such as $Al_2O_3$, $SiO_2$, or cordierite. The frit composed mainly of $V_2O_5$ may be a mixture of a $V_2O_5$—BaO—TeO—WO glass material and an oxide filler, such as $Al_2O_3$, $SiO_2$, or cordierite.

1-8. Tip Tube

The tip tube 81 is used to exhaust gases from the discharge space 12 and to introduce a discharge gas into the discharge space 12. After the discharge gas is introduced, the tip tube 81 is sealed by heating in order to prevent leakage of the discharge gas. The tip tube 81 may be a glass tube.

The tip tube 81 is joined to the first substrate 10 or the second substrate 11 with a sealing member 82. The first substrate 10 or the second substrate 11 has a through-hole 80 for coupling with the tip tube 81. A discharge gas can be introduced into the discharge space 12 through the through-hole 80 and the tip tube 81 and can be exhausted from the discharge space 12 through the through-hole 80 and the tip tube 81. The sealing member 82 may be formed of the same material as the sealing member 70.

The ultraviolet light emitting device 1 may have two or more through-holes 80 and two or more tip tubes 81. For example, each of the through-holes 80 and each of the tip tubes 81 may be used for intake and exhaust.

2. Operation

The operation of the ultraviolet light emitting device 1 according to the present embodiment will be described below.

In the electrodes 20, rectangular wave or sine wave voltages of opposite phases are applied to a pair of first electrode 21 and second electrode 22. More specifically, the phase of the voltage applied to the first electrode 21 is opposite to the phase of the voltage applied to the second electrode 22. This causes a very high electric field between the first electrodes 21 and the second electrodes 22 and induces electrical discharge in the discharge gas contained in the discharge space 12. FIG. 1 schematically illustrates the electrical discharge 90 in the discharge space 12.

Xe or KrCl in the discharge gas generates excitation light, such as vacuum ultraviolet light or deep ultraviolet light, due to excitation by electrical discharge. Upon irradiation with the excitation light, the light-emitting layer 40 and the light-emitting layer 60 emit deep ultraviolet light.

The first substrate 10 and the second substrate 11 are formed of a material that is transparent to ultraviolet light. In the present embodiment, the first substrate 10 and the second substrate 11 are formed of sapphire glass, which is transparent to deep ultraviolet light. Thus, deep ultraviolet light from the light-emitting layer 40 is emitted outside the device from the first substrate 10 and the second substrate 11. In other words, as illustrated in FIG. 1, the ultraviolet light emitting device 1 emits the ultraviolet light 91 outside the device from opposite sides thereof.

3. Production Method 3-1. Outline

A method for producing the ultraviolet light emitting device 1 according to the present embodiment will be described below.

First, the electrodes 20 are formed on the first substrate 10. The electrodes 20 are formed by patterning a metal film by a known method, such as an exposure process, a printing process, or a vapor deposition process.

A dielectric paste is then applied, for example, by die coating only to the first regions 92 on the main surface of the first substrate 10 in such a manner as to cover the electrodes 20 on the main surface of the first substrate 10, thereby forming a dielectric paste (dielectric material) layer. The dielectric paste is not applied to the second regions 93 but is applied only to the first regions 92 in the form of islands. The paste can be applied only to the first regions 92 by using a screen mask that allows the paste to be applied only to the first regions 92. The dielectric paste is a paste of a dielectric material, for example, a coating liquid containing a dielectric material, such as a glass powder, a binder, and a solvent.

The dielectric paste layer is left to stand for a predetermined time for leveling, thus forming a flat surface. The dielectric paste layer is then baked and solidified to form the dielectric layer 30 covering the electrodes 20.

The protective layer 50 is then formed on the dielectric layer 30. The protective layer 50 may be formed from a pellet of MgO, CaO, SrO, BaO, or a mixture thereof by a thin film forming method. The thin film forming method may be a known method, such as an electron-beam evaporation method, a sputtering method, or an ion plating method. The practical upper pressure limit may be 1 Pa in a sputtering method and 0.1 Pa in an electron-beam evaporation method, which is one of evaporation methods.

The protective layer 50 may be omitted.

The light-emitting layer 40 is then formed in the second regions 93. For example, the light-emitting layer 40 is formed by applying a paste containing a light-emitting material only to the second regions 93 and drying and baking the paste. The light-emitting material may contain a halogen atom and powdered magnesium oxide. The paste can be applied only to the second regions 93 by using a screen mask that allows the paste to be applied only to the second regions 93.

In the same manner as in the light-emitting layer 40, the light-emitting layer 60 is formed on the second substrate 11. The light-emitting layer 60 may have a uniform thickness. The light-emitting layer 60 may have a thickness smaller than the thickness of the light-emitting layer 40. This can reduce the amount of ultraviolet light absorbed by the light-emitting layer 60 relative to the amount of ultraviolet light emitted from the light-emitting layer 40.

A sealing material is then applied to at least one of the first substrate 10 and the second substrate 11. In the present embodiment, the sealing material is circularly applied to the periphery of the first substrate 10. The sealing material may be a frit paste. The sealing material is then calcined at a temperature of approximately 350° C. in order to remove the resin component(s) of the sealing material. Thus, the calcined sealing member 70 is formed.

The first substrate 10 and the second substrate 11 are then joined together. A functional furnace used in a sealing step will be described below with reference to FIG. 3.

3-2. Functional Furnace

Figure 3:
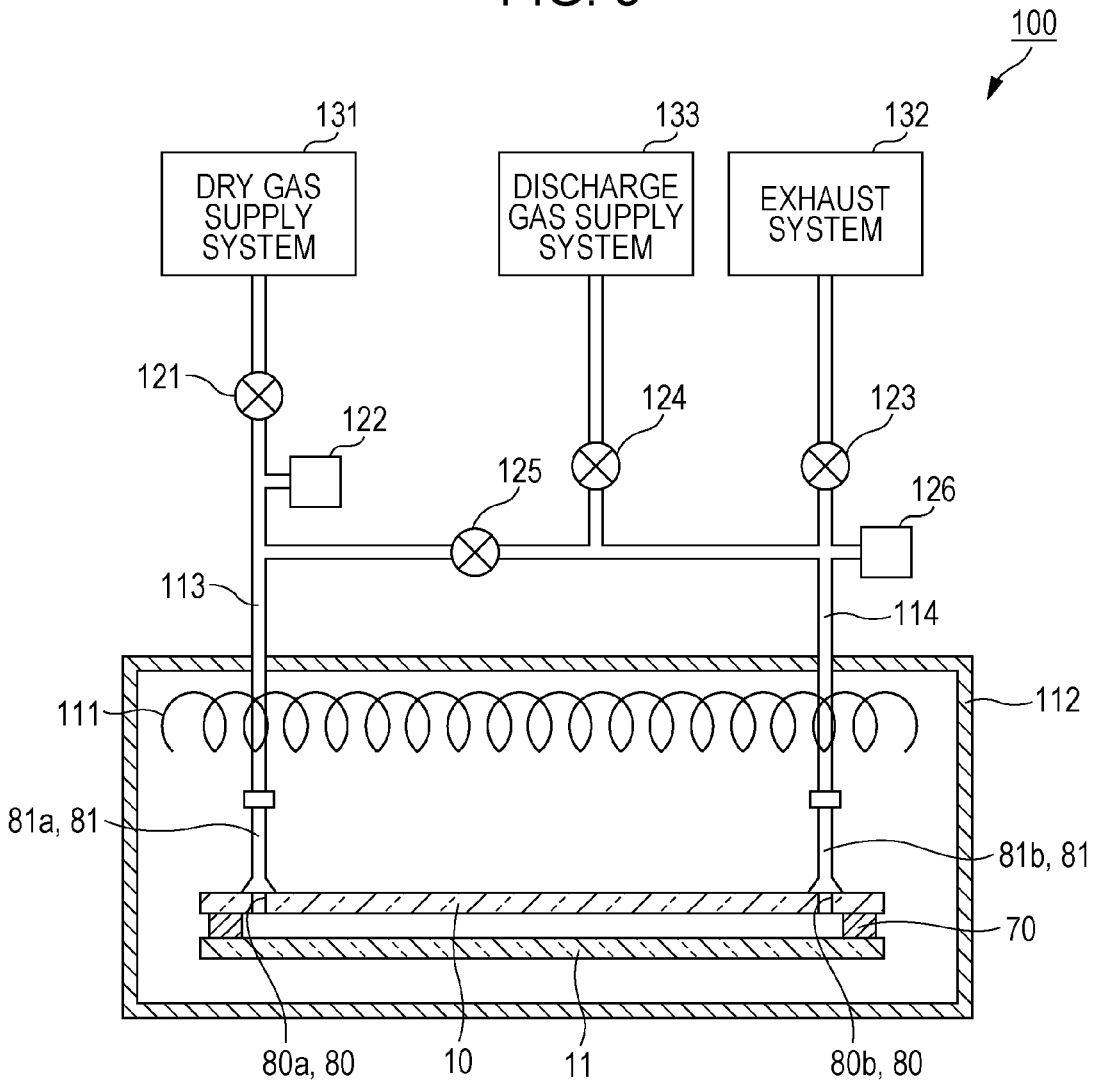
FIG. 3 is a schematic view of a functional furnace used in the production of an ultraviolet light emitting device according to one embodiment.

FIG. 3 is a schematic view of a functional furnace 100 used in the production of the ultraviolet light emitting device 1 according to the present embodiment.

The functional furnace 100 is used in the sealing step. The functional furnace 100 can supply and exhaust a gas in the sealing step.

As illustrated in FIG. 3, the functional furnace 100 includes a furnace 112 including an internal heater 111. In the furnace 112, the first substrate 10 is disposed vertically upward from the second substrate 11. The first substrate 10 is provided with the calcined sealing member 70 and tip tubes 81*a* and 81*b*. The first substrate 10 and the second substrate 11 are fixed with fixing means (not shown), such as clips. Likewise, the first substrate 10 and the tip tubes 81*a* and 81*b* are fixed with fixing means (not shown). The tip tubes 81*a* and 81*b* communicate with the discharge space 12 via through-holes 80*a* and 80*b* bored in the first substrate 10.

As illustrated in FIG. 3, the tip tube 81*a* is coupled to piping 113. The piping 113 is coupled to a dry gas supply system 131 outside the furnace 112 through a valve 121. The piping 113 is provided with a gas relief valve 122.

The tip tube 81*b* is coupled to piping 114. The piping 114 is coupled to an exhaust system 132 outside the furnace 112 through a valve 123. The piping 114 is coupled to a discharge gas supply system 133 outside the furnace 112 through a valve 124. The piping 114 is also coupled to the piping 113 through a valve 125. The piping 114 is equipped with a pressure gauge 126.

3-3. Sealing Step

The sealing step will be described below with reference to FIGS. 4 and 5.

Figure 4:
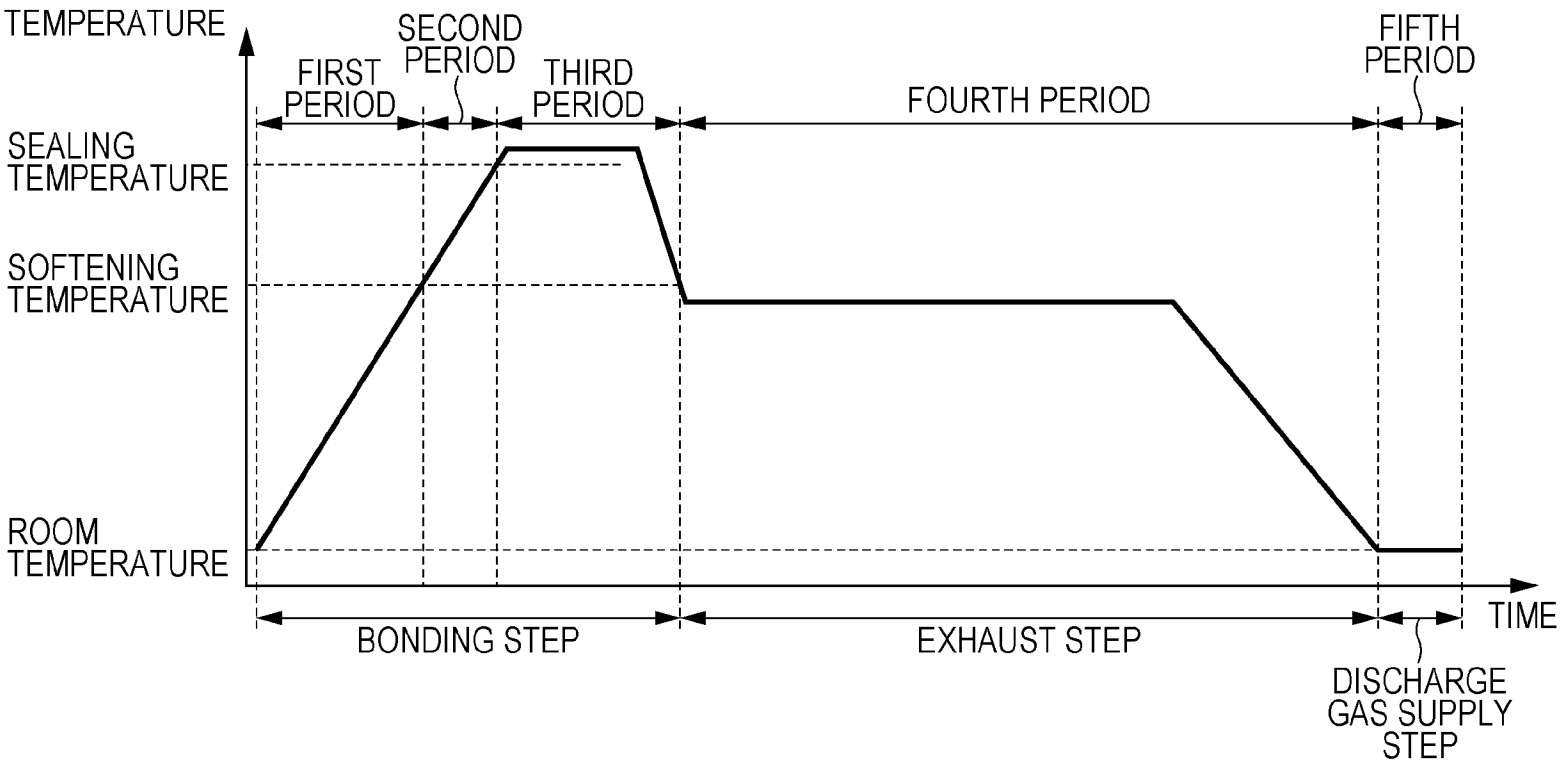
FIG. 4 is a temperature profile of a functional furnace according to one embodiment.

FIG. 4 is a temperature profile of the functional furnace 100 according to the present embodiment. FIG. 5 is a schematic view of gas and gas flows in the sealing step according to the present embodiment.

The sealing step includes a bonding step, an exhaust step, and a discharge gas supply step. For convenience of explanation, as illustrated in FIG. 4, the sealing step is divided into five periods (first to fifth periods) on the basis of the temperature of the functional furnace 100.

In the first period, the temperature of the functional furnace 100 is increased from room temperature to the softening point (softening temperature). In the second period, the temperature of the functional furnace 100 is increased from the softening point to the sealing temperature. In the third period, the temperature of the functional furnace 100 is maintained at a temperature equal to or higher than the sealing temperature for a predetermined period and is then decreased to the softening point. The first to third periods correspond to the bonding step. In the fourth period, the temperature of the functional furnace 100 is maintained at a temperature close to or lower than the softening temperature for a predetermined period and is then decreased to room temperature. The fourth period corresponds to the exhaust step. In the fifth period, the temperature of the functional furnace 100 is maintained at room temperature. The fifth period corresponds to the discharge gas supply step.

The softening point refers to a temperature at which the sealing material softens. For example, $Bi_2O_3$ sealing materials have a softening temperature of approximately 430° C.

The sealing temperature refers to a temperature at which the first substrate 10 and the second substrate 11 are joined together with the sealing material and a temperature at which the first substrate 10 and the tip tubes 81 are joined together with the sealing material. For example, the sealing temperature in the present embodiment is approximately 490° C. The sealing temperature may be determined in advance as described below.

For example, while the first substrate 10 is disposed vertically upward from the second substrate 11, the valves 121, 124, and 125 are closed, and only the valve 123 is opened. While the gas is exhausted from the device (the discharge space 12) with the exhaust system 132 through the tip tube 81*b*, the furnace 112 is heated with the heater 111. At a certain temperature, the internal pressure of the device measured with the pressure gauge 126 decreases stepwise and does not increase significantly even after the valve 123 is closed. This temperature is the sealing temperature at which the device is sealed.

The sealing step will be described in detail below with reference to FIG. 5. In FIG. 5, (*a*) to (*e*) illustrate the gas in the device (the discharge space 12) and the gas flow in the first to fifth periods illustrated in FIG. 4.

<Bonding Step>

First, the first substrate 10 is appropriately placed vertically upward from the second substrate 11. As illustrated in FIG. 5(*a*), while the valve 121 and the valve 125 are opened, a dry gas 190 is introduced into the device through the through-holes 80*a* and 80*b*, and the furnace 112 is heated to the softening temperature of the sealing member 70 with the heater 111 (the first period).

Figure 5:
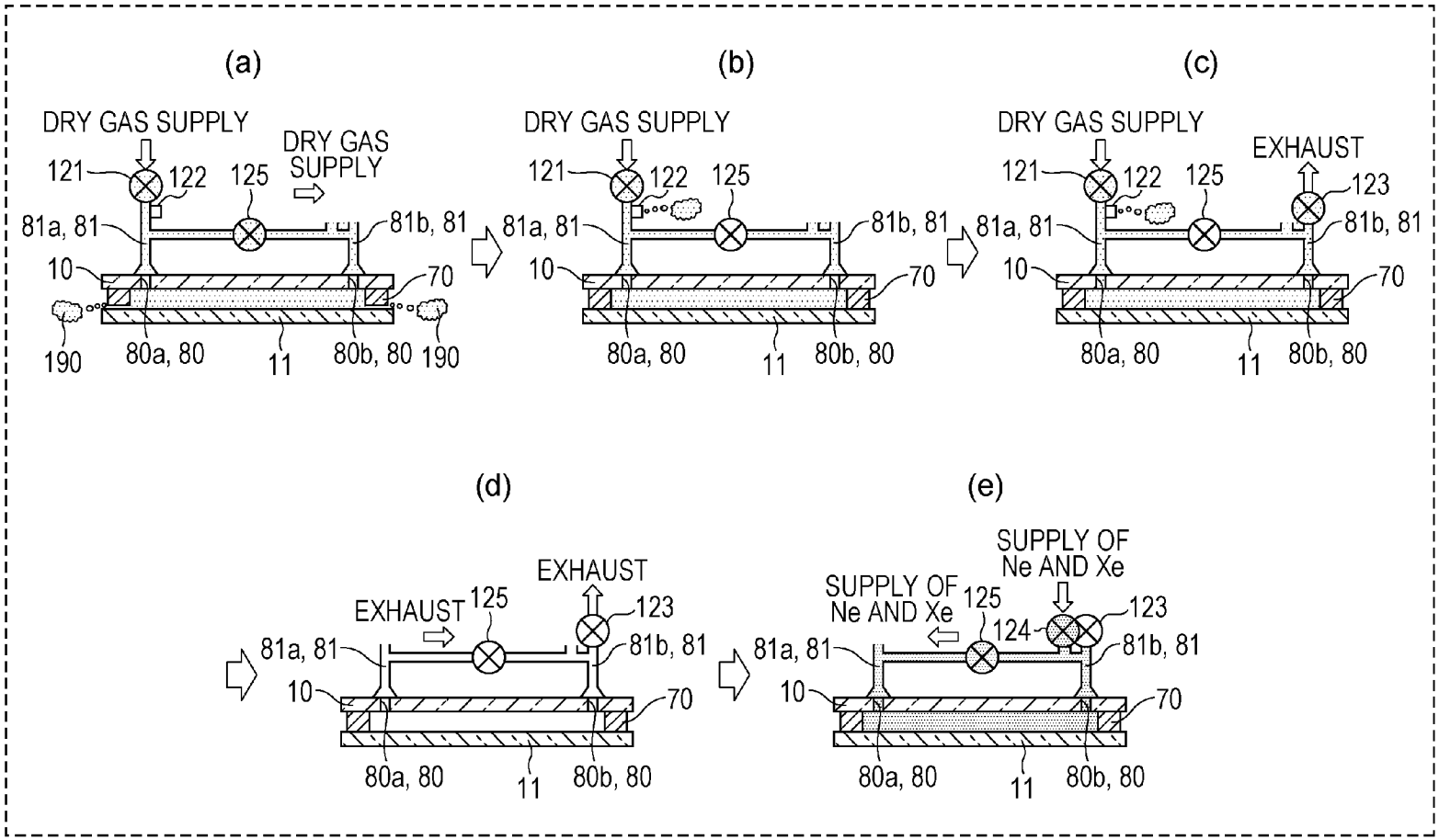
FIG. 5 is a schematic view of gas and gas flows in a sealing step according to one embodiment.

As illustrated in FIG. 5(*a*), the dry gas 190 leaks from the device through a gap between the second substrate 11 and the sealing member 70.

The dry gas may be a dry nitrogen gas having a dew point of −45° C. or less. The flow rate of the dry gas may be 5 L/min.

When the internal temperature of the furnace 112 reaches or exceeds the softening temperature of sealing frit, as illustrated in FIG. 5(*b*), the valve 125 is closed, and the flow rate of a dry nitrogen gas is decreased with the valve 121 to less than or equal to the half (for example, 2 L/min) of the flow rate employed in the first period. The gas relief valve 122 is then opened so that the internal pressure of the device can be slightly higher than the internal pressure of the furnace 112. The internal temperature of the furnace 112 is then increased to the sealing temperature (the second period).

When the internal temperature of the furnace 112 reaches or exceeds the sealing temperature, the sealing member 70 melts and joins the first substrate 10 to the second substrate 11 and the first substrate 10 to the tip tubes 81. As illustrated in FIG. 5(*c*), the internal pressure of the device is made slightly negative (for example, $8.0\times10^4$ Pa) with the exhaust system 132 through the valve 123. Thus, the dry nitrogen gas is introduced through the tip tube 81*a* and is exhausted through the tip tube 81*b*, thereby flowing continuously through the device while the internal pressure of the device is maintained at a slightly negative pressure.

The internal temperature of the furnace 112 is maintained at a temperature equal to or higher than the sealing temperature for approximately 30 minutes with the heater 111. During this period, the molten sealing member 70 flows slightly, and the internal pressure of the device is maintained at a slightly negative pressure. Thus, the first substrate 10 and the second substrate 11 are sealed, and the first substrate 10 and the tip tubes 81 are precisely joined together. The heater 111 is then turned off to decrease the temperature of the furnace 112 to or below the softening point (the third period).

<Exhaust Step>

In the exhaust step, the gas is exhausted from the device. As illustrated in FIG. 5(*d*), when the internal temperature of the furnace 112 decreased to or below the softening temperature, the valve 121 is closed, the valve 123 and the valve 125 are opened, and the gas is exhausted from the device through the through-holes 80 and the tip tubes 81. The gas is continuously exhausted from the device while the internal temperature of the furnace 112 is maintained for a predetermined time with the heater 111. The heater 111 is then turned off to decrease the internal temperature of the furnace 112 to room temperature. During this period, the gas is continuously exhausted from the device (the fourth period).

<Discharge Gas Supply Step>

In the discharge gas supply step, a discharge gas, for example, composed mainly of Ne and Xe is supplied to the evacuated device. After the internal temperature of the furnace 112 is decreased to room temperature, as illustrated in FIG. 5(*e*), the valve 123 is closed, and the valve 124 and the valve 125 are opened to supply the discharge space 12 with the discharge gas at a predetermined pressure through the tip tubes 81 and the through-holes 80 (the fifth period).

The ultraviolet light emitting device 1 according to the present embodiment can be produced through these steps.

4. Advantages

The characteristics and advantages of the ultraviolet light emitting device 1 according to the present embodiment will be described below.

In an ultraviolet light emitting device that includes a dielectric layer formed of low-melting-point glass, it is difficult to efficiently emit deep ultraviolet light generated by the light-emitting layer from opposite sides of the ultraviolet light emitting device. This is because the dielectric layer absorbs most of the deep ultraviolet light and thereby reduces the amount of deep ultraviolet light emitted from the side on which the dielectric layer is located.

In order to solve the problem, the ultraviolet light emitting device 1 according to the present embodiment includes the first substrate 10, the electrodes 20 located directly or indirectly on the main surface of the first substrate 10, the dielectric layer 30 that is located in the first regions 92 directly or indirectly on the main surface of the first substrate 10 in such a manner as to cover the electrodes 20 and is not located in the second regions 93 directly or indirectly on the main surface of the first substrate 10 different from the first regions 92, the first regions 92 including a region in which the electrodes 20 are located, the second substrate 11 facing the main surface of the first substrate 10, and the light-emitting layer 40 that is located in the second regions 93 and emits ultraviolet light. The first substrate 10 and the second substrate 11 are composed mainly of a material that is transparent to ultraviolet light. The discharge space 12 between the first substrate 10 and the second substrate 11 is filled with a predetermined gas. The light-emitting layer 40 emits ultraviolet light in the gas due to electrical discharge between the electrodes 20.

The dielectric layer 30 that absorbs ultraviolet light is absent between the light-emitting layer 40 and the first substrate 10 and between the light-emitting layer 40 and the second substrate 11. This can prevent ultraviolet light emitted from the light-emitting layer 40 from being absorbed by the dielectric layer 30. Thus, the ultraviolet light emitting device 1 according to the present embodiment can efficiently emit ultraviolet light from opposite sides thereof.

In the present embodiment, the initial discharge voltage of the ultraviolet light emitting device 1 is strongly influenced by the secondary electron emission characteristics of the dielectric layer 30 located directly above the electrodes 20. Thus, as illustrated in FIG. 1, it is very effective to provide the protective layer 50 having good secondary electron emission characteristics on the dielectric layer 30. The protective layer 50 is preferably formed of a material having good secondary electron emission characteristics and high ion bombardment resistance. For example, a MgO thin film has stable high ion bombardment resistance and can provide an ultraviolet light emitting device that has a very small time-dependent change in discharge intensity and high emission intensity.

Figure 6:
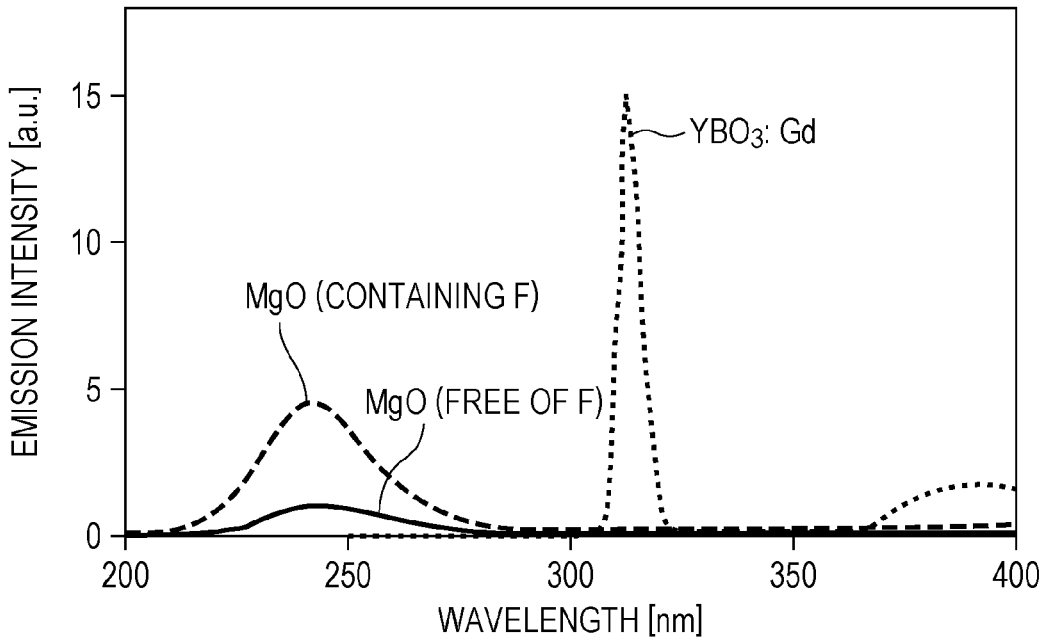
FIG. 6 is a graph of the emission intensity of light-emitting materials for a light-emitting layer.

FIG. 6 shows the emission spectrum of a phosphor material $YBO_3$:Gd doped with a rare-earth luminescent center and the emission spectra of powdered MgO that emits light of approximately 230 nm.

As illustrated in FIG. 6, powdered MgO (hereinafter referred to as a "MgO powder") emits deep ultraviolet light having a peak at approximately 230 nm and can therefore be used as a material of the light-emitting layer 40. Because MgO is a material having good secondary electron emission characteristics, MgO in the light-emitting layer 40 can achieve a lower initial discharge voltage than phosphor materials doped with a rare-earth luminescent center. Furthermore, MgO has high ion bombardment resistance and can suppress the degradation of the light-emitting layer 40 due to ion bombardment. Thus, in the ultraviolet light emitting device 1, it is probably very effective to use a MgO powder in the light-emitting layer 40.

The addition of a halogen atom to a MgO powder can increase deep ultraviolet emission intensity. Thus, a MgO powder containing a halogen atom can emit strong deep ultraviolet light and is therefore suitable for the ultraviolet light emitting device 1 according to the present embodiment.

The addition of fluorine to the protective layer 50 can decrease the initial discharge voltage. Thus, as illustrated in FIG. 6, the addition of fluorine to a MgO powder as a halogen atom can increase the emission intensity of the light-emitting layer 40.

A halogen atom in a MgO powder (the light-emitting layer 40) or a halogen atom in the protective layer 50 moved from a MgO powder (the light-emitting layer 40) can be analyzed by X-ray photoelectron spectroscopy (XPS) or inductively coupled plasma (ICP) emission spectrometry.

The gas to be filled in the discharge space 12 may be Ne, KrCl, $N_2$, CO, or Xe, as described above. When a MgO powder is used in the light-emitting layer 40, a gas mixture of Ne and Xe is suitable. MgO powders have a wide band gap and most efficiently emit light in response to excitation light of approximately 150 nm. When the discharge gas is KrCl or Xe alone, a large proportion of excitation light has a wavelength of more than 172 nm. When the discharge gas is a gas mixture of Ne and Xe, a large proportion of excitation light has a wavelength of 147 nm, and the MgO powder is effectively excited.

In the light-emitting layer 40 formed from a powdered material, the adhesiveness of a film of the powdered material is a major concern. Thus, a surface on which the light-emitting layer 40 is to be formed (for example, the main surface of the first substrate 10) may be roughened so that the powder material of the light-emitting layer 40 can be easily retained to form a film. Roughening can improve the adhesion between the light-emitting layer 40 and the protective layer 50. This is also true for the light-emitting layer 60. For example, roughening the main surface of the second substrate 11 (facing the discharge space 12) can improve the adhesion between the light-emitting layer 60 and the second substrate 11.

5. Examples

Examples of the ultraviolet light emitting device 1 according to the embodiment and Comparative examples were prepared, and their characteristics were compared.

The structure of the electrodes of these ultraviolet light emitting devices is illustrated in FIG. 2. Two comb-like electrodes constituted an interdigitated structure. The electrodes 20 were formed from Ag by resistance-heating evaporation. The distance between adjacent pair of first electrode 21 and second electrode 22 was 6 mm, and each of the first electrode 21 and the second electrode 22 had a width of 1 mm.

The first substrate 10 and the second substrate 11 were formed of sapphire glass, which is transparent to deep ultraviolet light. The light-emitting layers 40 and 60 facing the discharge space 12 were located on the first substrate 10 and the second substrate 11, respectively. One side (an outer main surface) of the sapphire glass was polished, and the other main surface of the light-emitting layer 40 or 60 facing the discharge space 12 was unpolished. This improved the adhesion of the light-emitting layer 40 or 60.

The discharge space 12 was filled with a discharge gas composed of a gas mixture of Ne (95%) and Xe (5%) at 10 kPa.

The protective layer 50 having a thickness of 1 μm was formed on the dielectric layer 30 by electron beam vacuum evaporation of MgO. The protective layer 50 was formed with a deposition mask only in a region in which the dielectric layer 30 was located, that is, in the first regions 92.

An alternating voltage of a 30-kHz rectangular wave was applied to the electrodes 20. Rectangular wave voltages of opposite phases were applied to the first electrodes 21 and the second electrodes 22.

The initial discharge voltage was measured as follows: first, the rectangular wave voltage applied to the electrodes was increased to 950 V, thereby allowing the ultraviolet light emitting device to emit light. The rectangular wave voltage was then decreased to 0 V to interrupt the light emission from the entire device. The rectangular wave voltage was then increased, and the voltage at which electrical discharge spread over the discharge space 12 was measured as the initial discharge voltage.

The emission intensity is a relative value based on the emission intensity of an ultraviolet light emitting device including a dielectric layer over the entire surface. The emission intensity on the outermost surface of a structure (for example, the first substrate 10 or the second substrate 11) of an ultraviolet light emitting device that is transparent to ultraviolet light was measured with a photonic multichannel analyzer (C10027-01 manufactured by Hamamatsu Photonics K.K.) and was digitized by integration in the emission wavelength region. For example, for a light-emitting layer formed from a MgO powder, which has an emission peak at approximately 230 nm, the emission intensity was integrated over the range of 200 to 280 nm. The relative value is based on the emission intensity of an ultraviolet light emitting device according to Comparative Example 1 measured immediately after the production thereof, which is taken as 100.

Ultraviolet light from an ultraviolet light emitting device is emitted from the first substrate 10 and the second substrate 11. Thus, the emission intensity of the entire ultraviolet light emitting device was determined by summing both outputs.

FIG. 7 is a table of the characteristic evaluation results for the ultraviolet light emitting devices according to the present embodiment and comparative examples.

As illustrated in FIG. 7, Comparative Examples 1 and 2 were prepared. In Comparative Examples 1 and 2, the dielectric layer 30 was located on the entire main surface of the first substrate 10 (in both the first regions 92 and the second regions 93). The dielectric layer 30 in Comparative Examples 1 and 2 had a thickness of 20 μm.

The light-emitting layer 40 was formed over the entire upper surface of the dielectric layer 30 (facing the second substrate 11). The material of the light-emitting layers 40 and 60 was $YBO_3$:Gd in Comparative Example 1 and a MgO powder having a peak wavelength in the range of 200 to 300 nm in Comparative Example 2. Each of the light-emitting layers 40 and 60 had a thickness of 20 μm. The MgO powder used for the light-emitting layers 40 and 60 contained fluorine as a halogen atom, which was identified by XPS.

Example 1 is an ultraviolet light emitting device according to the present embodiment and has the same structure as Comparative Example 1 except that the dielectric layer 30 is located only in the first regions 92. In order to completely cover the electrodes 20 with the dielectric layer 30, the dielectric layer 30 was formed with a screen mask that was wider by 0.5 mm on each side than the mask used to form the electrodes 20. Thus, the dielectric layer 30 on the electrodes 20 was wider by 0.5 mm on each side than the width of the electrodes 20. The dielectric layer 30 had a thickness of 20 μm.

Example 2 is an ultraviolet light emitting device according to the present embodiment and has the same structure as Comparative Example 2 except that the dielectric layer 30 is located only in the first regions 92. The dielectric layer 30 had the shape described in Example 1.

FIG. 7 shows that the formation of the dielectric layer 30 only in the first regions 92 improved emission intensity by approximately 10% to 30%. The use of the MgO powder containing fluorine in the light-emitting layers 40 and 60 decreased the initial discharge voltage as compared with the light-emitting layers 40 and 60 formed of $YBO_3$:Gd.

It was also found that the protective layer 50 improved emission intensity by approximately 10% to 30%.

Other Embodiments

Although the ultraviolet light emitting devices according to one or two or more embodiments are described above, the present disclosure is not limited to these embodiments. Various modifications of these embodiments and combinations of constituents of different embodiments conceived by a person skilled in the art without departing from the gist of the present disclosure are also fall within the scope of the present disclosure.

For example, although the protective layer 50 under the light-emitting layer 40 was the MgO thin film in the embodiments, the protective layer 50 is not limited to the MgO thin film. The protective layer 50 may be formed of CaO, BaO, SrO, or a mixed-phase layer thereof, instead of MgO. The protective layer 50 formed of one of these materials can also achieve good electron emission characteristics and suppress the time-dependent decrease in emission intensity during continuous emission.

Although the light-emitting layer 60 having a thickness of 5 μm was formed on the second substrate 11 in the embodiments, the present disclosure is not limited to this. For example, the time-dependent decrease in emission intensity during continuous emission can be suppressed without the light-emitting layer 60 on the second substrate 11.

Although the MgO powder containing fluorine as a halogen atom was used as a material of the light-emitting layer in the embodiments, a halogen atom other than fluorine, such as chlorine (Cl), may be used. Alternatively, the light-emitting layer may contain no halogen atoms. Also in such a case, as illustrated in FIG. 6, the MgO powder can emit ultraviolet light having a peak in the range of 200 to 300 nm.

Although the second substrate 11 in the embodiments was formed of sapphire glass having a polished surface and had a rough surface on which the light-emitting layer 60 was formed, the present disclosure is not limited to this. For example, the second substrate 11 may have a rough surface formed by sandblasting.

Although the gas mixture of Ne and Xe was used as a discharge gas in the embodiments, Xe may be used alone, or another gas, such as $F_2$, may be used.

Although the light-emitting layer 40 was formed only in the second regions 93 in the embodiments, the present disclosure is not limited to this. The light-emitting layer 40 may also be formed in the first regions 92. For example, the light-emitting layer 40 may be formed on the protective layer 50 (on the dielectric layer 30 in the absence of the protective layer 50). In this case, although ultraviolet light emitted from the light-emitting layer 40 toward the dielectric layer 30 is absorbed by the dielectric layer 30, ultraviolet light emitted toward the discharge space 12 is emitted outside the device from light-emitting layer 60 and the second substrate 11. This can increase the emission intensity of the ultraviolet light emitting device 1.

Although the protective layer 50 was formed only in the first regions 92 in such a manner as to cover the dielectric layer 30 alone in the embodiments, the present disclosure is not limited to this. The protective layer 50 may be formed in the second regions 93 as well as in the first regions 92. For example, the protective layer 50 may be formed in the second regions 93 between the light-emitting layer 40 and the first substrate 10.

Although the first substrate 10 and the second substrate 11 were flat sheets, that is, the ultraviolet light emitting device was a panel in the embodiments, the present disclosure is not limited to this. For example, each of the first substrate 10 and the second substrate 11 may be a curved sheet having a curved main surface. For example, each of the first substrate 10 and the second substrate 11 may be tubular. More specifically, the inner diameter of the second substrate 11 may be greater than the outer diameter of the first substrate 10, and the first substrate 10 may be located within the second substrate 11. This allows ultraviolet light to be emitted in all directions from a side surface of the second substrate 11.

Various modifications, replacement, addition, and omission may be made to the embodiments within the scope and equivalents of the appended claims.

The present disclosure can provide an ultraviolet light emitting device having a small time-dependent decrease in emission intensity during continuous emission and can be applied to sterilization, water purification, lithography, and illumination.

What is claimed is:

1. An ultraviolet light emitting device comprising:

a first substrate that has a first main surface and is transparent to ultraviolet light;

a second substrate that has a second main surface and a third main surface and is transparent to ultraviolet light, the second main surface facing the first main surface of the first substrate, the third main surface being opposite the second main surface;

a gas in a space between the first substrate and the second substrate;

electrodes directly or indirectly on the first main surface of the first substrate;

a dielectric layer that is located in a first region directly or indirectly on the first main surface of the first substrate and covers the electrodes, the dielectric layer being not located in a second region directly or indirectly on the first main surface of the first substrate, the second region being different from the first region, the first region including regions in which the electrodes are located; and a light-emitting layer that is located in the second region and/or located directly or indirectly on at least one of the second and third main surfaces of the second substrate and emits the ultraviolet light in the gas due to electrical discharge between the electrodes.

2. The ultraviolet light emitting device according to claim 1, wherein the light-emitting layer is not located directly or indirectly on a surface of the dielectric layer, the surface facing the second substrate.

3. The ultraviolet light emitting device according to claim 1, further comprising a thin film that is located directly or indirectly on the dielectric layer and contains at least one selected from the group consisting of magnesium oxide, calcium oxide, barium oxide, and strontium oxide.

4. The ultraviolet light emitting device according to claim 1, wherein the light-emitting layer contains powdered magnesium oxide that emits the ultraviolet light.

5. The ultraviolet light emitting device according to claim 4, wherein the light-emitting layer further contains a halogen atom.

6. The ultraviolet light emitting device according to claim 5, wherein the halogen atom is fluorine.

7. The ultraviolet light emitting device according to claim 1, wherein the first substrate and the second substrate comprise sapphire.

8. The ultraviolet light emitting device according to claim 1, wherein the gas contains neon and xenon.

9. The ultraviolet light emitting device according to claim 1, wherein the ultraviolet light has a peak wavelength in the range of 200 to 300 nm.

10. The ultraviolet light emitting device according to claim 1, wherein the light-emitting layer has a fourth surface that is located in the second region and that faces the first substrate, the dielectric layer has a fifth surface that faces the first substrate, and the fourth and fifth surfaces are substantially located directly on a hypothetical flat plane.

11. The ultraviolet light emitting device according to claim 1, wherein the first and second substrates are composed mainly of a material that is transparent to the ultraviolet light.

* * * * *